US006372001B1

(12) United States Patent
Omar et al.

(10) Patent No.: US 6,372,001 B1
(45) Date of Patent: Apr. 16, 2002

(54) ABRASIVE ARTICLES AND THEIR PREPARATIONS

(75) Inventors: Mohamed Omar; Heinz-Werner Schankweiler, both of Neuss (DE); Robert M. Burgess, Horsmonden (GB)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/509,625

(22) PCT Filed: Sep. 22, 1998

(86) PCT No.: PCT/US98/20048

§ 371 Date: Mar. 30, 2000

§ 102(e) Date: Mar. 30, 2000

(87) PCT Pub. No.: WO99/19116

PCT Pub. Date: Apr. 22, 1999

(30) Foreign Application Priority Data

Oct. 9, 1997 (GB) ..... 9721494

(51) Int. Cl.[7] ..... B24D 3/06; B24D 3/00; B24D 11/00; B24D 11/02; B24D 18/00

(52) U.S. Cl. ..... 51/298; 51/295; 51/297; 51/307; 51/309

(58) Field of Search ..... 51/297, 295, 298, 51/307, 309; 451/527, 533, 534, 539

(56) References Cited

U.S. PATENT DOCUMENTS

| | | | | |
|---|---|---|---|---|
| 4,256,467 A | | 3/1981 | Gorsuch | |
| 4,826,508 A | * | 5/1989 | Schwartz et al. | 51/298 |
| 5,086,088 A | | 2/1992 | Kitano et al. | |
| 5,840,141 A | * | 11/1998 | Korbel | 51/297 |

FOREIGN PATENT DOCUMENTS

| | | | |
|---|---|---|---|
| EP | 0 013 486 B1 | | 7/1980 |
| EP | 744248 A1 | * | 11/1996 |
| GB | 2 200 920 A | | 8/1988 |

* cited by examiner

*Primary Examiner*—Michael Marcheschi
(74) *Attorney, Agent, or Firm*—Scott A. Bardell

(57) ABSTRACT

An abrasive article comprising an abrasive fabric comprising a fabric having discrete areas of electro-deposited metal extending on or therethrough and having abrasive material embedded in the metal, a layer of adhesive, and a backing substrate, the abrasive fabric being bonded to the backing substrate by the layer of adhesive, characterized in that either (i) the surface of the abrasive fabric bonded to the backing has been roughened and/or (ii) the layer of adhesive comprises an epoxy-acrylate thermosetting adhesive.

21 Claims, 1 Drawing Sheet

ABRASIVE ARTICLES AND THEIR PREPARATIONS

CROSS REFERENCE TO RELATED APPLICATION

This application claims priority from PCT International Patent Application No. PCT/US98/20048, filed Sep. 23, 1998.

This invention relates to abrasive articles and to their preparations. In particular, the invention relates to abrasive articles of the type comprising a fabric material, discrete areas of electro-deposited metal extending on or through and carried by the fabric material, and having abrasive material embedded in the metal.

The preparation of electro-deposited abrasive layers through a fabric material is known in the art and disclosed, for example, in British Patent No. 2 200 920, European Patent No. 13486 and U.S. Pat. No. 4,256,467, amongst others. Generally, the abrasive layer is formed by laying a length of fabric, for example, a woven or non-woven mesh material, onto an electrically conducting surface and electro-depositing a metal onto the fabric material in the presence of an abrasive mineral such that the mineral becomes embedded in the metal. An insulating material is selectively applied to the fabric material or to the electrically conducting surface before deposition of the metal layer so that the metal can only deposit onto the fabric in those areas not covered by the insulating material, thereby defining the pattern of the abrading surface.

In one method of making an electro-deposited abrasive layer, a mesh material in the form of a woven fabric of electrically insulating material such as nylon, cotton, terylene, or the like, is screen printed with insulating material in the form of ink. The ink is ordinarily waterproof and acid resistant and in its preferred form is colour fast at elevated working temperatures of the abrasive article, for example, up to approximately 220° C. The ink should be compatible with any hot-melt adhesive, which may subsequently be applied to the abrasive layer to secure it to the backing material. The ink may be a resin based or oil based ink and coloured as desired.

The screen-printing may be conducted by conventional screen printing techniques in such a manner to ensure that the ink penetrates into and is absorbed onto defined areas of the fabric material leaving discrete areas without any insulating material, which defines the abrasive surface. Such discrete areas may be of any convenient shape and size, for example, circular, diamond-shaped, rectangular, etc.

In another method, an electrically insulating mask is applied to an electrically conducting surface, for example, a stainless steel drum, the fabric material laid on the electrically conducting surface, and metal electro-deposited through the fabric material in the presence of abrasive material to provide the discrete areas of metal containing abrasive material.

In a further method, an ink may be combined with an adhesive and screen-printed onto the fabric material. The metal is deposited, as described previously, and the resulting abrasive layer may be applied to a backing material by heating the abrasive layer to melt the adhesive content of the insulating material, thereby adhering the backing material to the abrasive layer.

In another method, instead of the insulating material being an ink, or an ink and adhesive combination, adhesive only may be used as the insulating material. In this case, the adhesive may be in the form of a sheet, which is applied to the fabric material before electro-deposition. Usually the adhesive sheet will be perforated and thereby formed with a plurality of openings of the desired shape and size before application to the fabric material. Preferably, this perforation will be by cutting out the openings from the sheet by any convenient means.

The adhesive sheet is then heated when in contact with the fabric material and pressure is applied to cause the adhesive to absorb and enter the spaces in the fabric material. When fully penetrated, the fabric material is cooled.

The fabric material is then electro-deposited with metal and abrasive as described previously.

The resulting abrasive layer has adhesive at both sides of the fabric material and surrounding the metal areas and can be readily adhered to a backing material by applying the backing material to the rear surface and heating to cause the adhesive to adhere the fabric material to the backing material. The adhesive is preferably a hot-melt adhesive, which is acid resistant and water repellant.

Other techniques for producing abrasive fabrics include the use of a fabric which is electrically conducting either by coating the fabric or fibres with metal or the use of metal fibres upon which metal is electro-deposited in a pattern-wise manner.

In principle, any metal, which may be electro-deposited, may be employed although in practice the metal is normally nickel. A wide range of abrasive particles may be embedded in the metal. Generally, the abrasive particles are diamond or synthetic boron nitride.

The abrasive layers comprising the mesh bearing the abrasive containing metal deposits, hereinafter referred to as "abrasive fabric", is usually bonded to a backing member, for example, a backing sheet of woven material or a solid substrate. Adhesive present in the abrasive fabric may be employed to bond to the backing member and/or adhesive may be applied to the backing and/or the abrasive mesh, for example, by coating, spraying, dipping, lamination, etc.

In a known method, the abrasive fabric is bonded under heat and pressure to a polyester-cotton fabric backing utilizing a hot-melt polyester adhesive. The adhesive may be applied in the form of a separate film, which is commercially available on a release paper carrier or may be present on the surface of the polyester-cotton fabric.

The heat and pressure of the bonding operation causes the hot-melt adhesive to flow penetrating the abrasive fabric. This bonding technique has been used in respect of abrasive products in the form of discs, blocks, files, and pads. The other surface of this polyester-cotton fabric backing may be bonded to a block, pad, or provided with an attachment surface for attachment of the abrasive product to a suitable support.

According to a second known technique, a solution of a two-part, cross-linkable polyurethane adhesive is prepared and the abrasive fabric is completely immersed in the solution and thereafter removed and allowed to dry. This operation is generally repeated at least once to build up a satisfactory thickness of adhesive.

One side of a flexible cloth backing substrate is coated with the same adhesive solution and allowed to dry. At least one further coat is generally applied.

The backside of the abrasive fabric and adhesive coated side of the cloth are placed in contact and heat and pressure applied to effect a bond.

Products comprising abrasive mesh bonded to a backing have been commercially available since the mid-1980 under the Registered TradeMarks DIAPAD and 3M. The abrasive materials have been available in the form of belts, discs, pads, and blocks, etc. and have been employed for abrading a wide range of hard materials including metals, glass and stones, such as, granite, marble, etc. Under certain severe conditions of use, particularly at high temperatures, it has been found that the metal deposits may be delaminated from the backing; and in extreme cases, the fabric may tear resulting in metal deposit being removed from the abrasive material.

Various attempts have been made to enhance the bonding of the metal deposits to the backing. For example, primers such as 3M 901 Silane Primer, Loctite SIP (self-indicating primer), Bostick 9253 primer, and Ciba Geigy DZ81 acid etch primer have been employed with adhesive but any improvement in properties was found to be marginal. A range of different adhesives, for example, reactive polyurethanes, polyesters, rubber, nitrile rubber, polythene, and polychloroprene rubber, have been employed without significant improvement in properties.

It is an object of the present invention to provide abrasive materials comprising abrasive mesh which have improved delamination properties.

According to one embodiment of the present invention, there is provided an abrasive article comprising:

an abrasive fabric comprising a fabric having discrete areas of electro-deposited metal extending on or therethrough and having abrasive material embedded in the metal, a layer of adhesive, and a backing substrate, the abrasive fabric being bonded to the backing substrate by the layer of adhesive, characterized in that either (i) the surface of the abrasive fabric bonded to the backing has been roughened, for example, by abrading, and/or (ii) the layer of adhesive comprises an epoxy-acrylate thermosetting adhesive.

According to a second embodiment of the invention, there is provided a method of making an abrasive article comprising:

providing an abrasive fabric comprising a fabric having discrete areas of electro-deposited metal extending on or therethrough and having abrasive material embedded in the metal, and bonding the abrasive fabric to a backing substrate with a layer of adhesive characterized in that prior to contacting the layer of adhesive the surface of the abrasive fabric is roughened, for example, by abrading.

According to a further embodiment of the invention, there is provided a method of making an abrasive article comprising:

providing an abrasive fabric comprising a fabric having discrete areas of electro-deposited metal extending on or therethrough and having abrasive material embedded in the metal, and bonding the abrasive fabric to a backing substrate with a layer of adhesive characterized in that the layer of adhesive comprises an epoxy-acrylate thermosetting adhesive.

The products of the invention exhibit improved delamination resistance of the metal deposits which results in longer lifetime and improved cutting rates for the abrasive articles.

Figure 1:
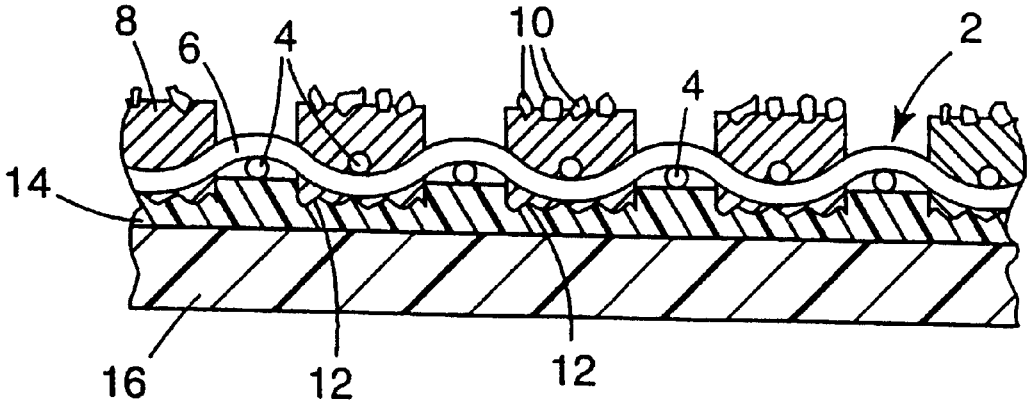
FIG. 1 is a cross-sectional view of an abrasive article of the invention.

It was postulated that the smooth surface of the metal deposits formed when the metal was electro-deposited on the electrically conducting surface did not provide an optimum surface for adhesive bonding. However, it was not believed to be readily feasible to roughen the surface. Electro-deposition of metal onto a roughened electrically conductive surface would result in mechanical bonding of the metal deposit preventing removal. Depending upon the fabric material, the abrasive fabric may be extremely flexible and easily torn which reduces the possibility of roughening of the surface of the metal deposits by mechanical means. The use of primers to modify the surface properties, including those, which etch the surface, did not provide significant improvement. It was found that such abrasive fabric could be subject to grit blasting under conditions which roughen the surface of the metal deposits without severely damaging the fabric mesh material. This was surprising since it was believed that the grit blasting conditions necessary to abrade the metal surface would cause destruction of the fabric mesh material.

The grit blasting may be conducted on any suitable machine, for example, Registered TradeMark GUYSON Model 300/20AD blast cleaning machine. The abrasive fabric may conveniently be supported from beneath on the bed of a grit-blasting machine. Alternatively, it may be clamped in any suitable position, for example, horizontally or vertically, in the path of the grit particles. Suitable grit include 36 to 80 grit aluminum oxide (such as Alumina Size 46 supplied by Abrasive Developments Ltd. of Henley-in-Arden, U.K.) or chilled iron grit. In general, grit blasting is conducted for up to 10 seconds per square inch, preferably for a period of from 2 to 5 seconds per square inch.

The treated abrasive mesh is dipped in solvent, for example, isopropyl alcohol, etc. to remove any dirt and thereafter bonded to a backing by conventional techniques.

The grit blasting provides a significant increase in surface roughening. Comparisons of the surface before and after grit blasting using UBM Topography equipment by placing samples on a glass slide and measuring an area of 0.25 mm×0.25 mm reveal an increase in Rz (average of 5 deepest scratches) from 2.1 $\mu$m to 6.6 $\mu$m and an increase in Ra (average surface finish) from 0.4 to 1.5 $\mu$m. Besides abrasion, any operation that provides the roughened surface finish can be used.

Other abrading techniques may be employed to abrade the surface of the metal deposits, for example, mechanical abrading using an abrasive belt or a non-woven abrasive web in the form of a wheel sheet or belt etc. Suitable non-woven abrasives are available from Minnesota Mining and Manufacturing Company, St. Paul, Minn. (3M) under the Registered TradeMark SCOTCHBRITE. The abrading process desirably increases Ra to at least 0.7 $\mu$m, preferably at least 1.0 $\mu$m, more preferably about 1.5 $\mu$m. The abrading process desirably increase Rz to at least 3 $\mu$m, preferably at least 4 $\mu$m, more preferably at least 5 $\mu$m.

It has also been found that one particular type of adhesive provides significantly improved delamination resistance. Epoxy-acrylate resins of the type disclosed in U.S. Pat. No. 5,086,088 provide improved bonding between the metal deposits and backing both for grit blasted and untreated metal deposits. Such materials are pressure-sensitive thermosetting adhesives comprising from about 30% to about 80% by weight of a photopolymerisable prepolymeric or monomeric syrup containing an acrylic ester and a polar copolymerisable monomer, from about 20% to about 60% by weight of an epoxy resin or a mixture of epoxy resins containing no photopolymerisable groups, from about 0.5% to about 10% by weight of a heat-activatable hardener for the epoxy resin, from about 0.01% to about 5% of a photoinitiator, and from 0% to about 5% of a photocrosslinking agent. Imidazoles and thermally expandable thermoplastic microspheres may be utilized in the adhesive formulation. Adhesives of this type are commercially available from 3M as 3M Epoxy Tape 9245. The abrasive articles of the invention may be prepared by laminations under pressure of the abrasive fabric to the backing using the 3M Epoxy Tape 9245.

The invention will now be described with reference to FIG. 1.

The abrasive material comprises a fabric (2) in the form of a one-over-one mesh having warp filaments (4) and weft filaments (6). The fabric has discrete islands (8) of electro-deposited metal having abrasive grains (10) embedded in the top surface of the islands. The elements denoted by reference numerals 2 to 10 constitute an abrasive fabric.

In accordance with one embodiment of the invention, the lower surface (12) of the electro-deposited islands (8) is roughened by abrading, for example, grit blasting. A layer of adhesive (14), which preferably comprises an epoxy-acrylate thermosetting adhesive, bonds the abrasive fabric to a backing substrate (16).

The fabric materials used to make the abrasive fabric may be selected from a wide range of materials, which may be insulating or electrically conductive depending upon the method for manufacturing the abrasive fabric. Suitable electrically insulating materials include woven and non-woven fabrics of cotton, nylon, polyester, Terylene, and Kevlar. Preferred insulating fabrics for use in the invention comprise screen printing cloths, particularly monofilament polyester one-over-one weave screen printing cloths. Electrically conducting materials may be woven or non-woven and may comprise conducting fibres such as metals, or insulating fibres, which are at least partially coated with a conducting material.

The invention will be illustrated by the following Examples.

The abrasive fabrics used in the following Examples were identical to the abrasive fabrics used in the abrasive materials Green 21, Black 18 and Red 18 commercially available from 3M United Kingdom plc. The abrasive fabrics comprise a monofilament polyester one-over-one mesh cloth having a mesh size of 55 $\mu$m and a strand thickness of 27 $\mu$m; the fabric is commercially available under the trade designation PES 55/27 from Sercol fabric having circular islands of electrodeposited nickel having diamond embedded therein. Green (GN) denotes a diamond particle size of 250 $\mu$m, Black (BK) denotes a diamond particle size of 125 $\mu$m and Red (RD) denotes a diamond particle size of 74 $\mu$m. The numeral 21 refers to a pattern of large circular islands of about 4 mm diameter and the numeral 18 refers to a pattern of small circular islands of about 1.5 mm.

EXAMPLE 1

Grit Blasting and Bonding with Polyurethane

GN21 and BK18 abrasive fabrics were grit blasted in a Registered TradeMark GUYSON Model 300/20AD blast cleaning machine using aluminum oxide Safti Grit White 46 for about 5 seconds per square inch.

The abrasive fabrics were dipped in isopropylalcohol to remove any dirt.

The abrasive fabrics were dipped in an adhesive bath comprising 46 parts Bostik 3206 adhesive, 6 parts Bostik D1000 activator, and 48 parts Bostik M576 thinner, and suspended from one end to drip dry. The operation was repeated suspending from the opposite end.

A polycotton backing material was roller coated with an adhesive composition comprising 71 parts Bostik 3206 adhesive, 9 parts Bostik D1000 activator, and 20 parts Bostik M576 thinner, and allowed to dry. A second coat of adhesive was applied.

The backing was laminated to the back of the abrasive mesh material under heat and pressure. The backing and abrasive mesh material were placed in a horizontal platten press and heated to 120° C. for 5 seconds under a pressure of about 6 lb/in$^2$ (41.4 kPa). Immediately thereafter the laminate was passed through the nip of two rollers having a diameter of 3 inches and a length of 270 mm, one roller was steel and the other roller having a silicon coating. The rollers were pressurized by 2-inch diameter (5 cm) air rams at each end under an air pressure of 100 lb/in$^2$ (689 kPa).

The front of the resulting material was roller coated with adhesive and a polycotton substrate laminated thereto leaving unbonded tails at one edge of the resulting laminate. Additional samples were prepared using standard GN21 and BK1 8 materials.

Samples were tested on an Instron tensile machine by clamping each of the unbonded tails and pulling the laminates apart. The following test parameters were used:

Load cell=1.00 kN

Crosshead speed=100.00 mm/min

Sample rate=6.667 (pts/sec)

Specimen width=25 mm

Specimen thickness=2.5 mm

The delamination force is reported in the following Table.

| Sample | Delamination Force (kN) |
|---|---|
| GN21 Standard | 0.078 |
| GN21 Grit blasted | 0.092 |
| BK18 Standard | 0.065 |
| BK18 Grit blasted | 0.086 |

The results indicate grit blasting improves the bond between the metal deposits and backing. After delamination in the samples of the invention, adhesive residue was attached to the back of the metal deposits whereas the back of the metal deposits in the standard materials were clean. Also, some samples of the invention delaminated at the interface between the front polycotton substrate and the diamond abrasive on the front of the metal deposits. In these samples the delamination force did not correspond to the bond strength between the backing and the back of the metal deposits since that bond had not been broken. Thus, the bond strength between the backing and the back of the metal deposits is higher than the recorded delamination force in those samples.

EXAMPLE 2

Grit Blasting and Bonding with Hot-melt Adhesive

Black 18 and Red 18 abrasive fabrics were grit blasted as described in Example 1.

The abrasive mesh materials were dipped in isopropyl alcohol to remove any dirt.

A backing substrate comprising polyester-cotton blended woven cloth with a film of polyester hot-melt adhesive was pre-pressed for 20 seconds at elevated temperature to force the adhesive into to the cloth.

The abrasive fabric was then laminated to the prepared polyester-cotton cloth by hot pressing the abrasive fabric against the hot-melt adhesive for 20 to 25 seconds to re-flow the adhesive and form a bond.

The front of the resulting material was laminated to a polycotton substrate and tested as in Example 1.

The results are reported in the following Table.

| Sample | Delamination Force (kN) |
|---|---|
| Black 18 Standard | 0.023 |
| Black 18 Grit blasted | 0.032 |
| Red 18 Standard | 0.034 |
| Red 18 Grit blasted | 0.050 |

Grit blasting improves the bond between the metal deposits and backing. After delamination, in the samples of the invention adhesive residue was attached to the back of the metal deposits whereas the back of the metal deposits in the standard materials were clean. Also some samples of the invention broke on the face of the diamond abrasive which would indicate the possibility of a higher real bond, which would mean a true measure of the effect of abrading the material could not be obtained. This is because the failure point of this test is normally always where the lamination of the abrasive member to the backing parts and not the failure of the abrasive member to the front supportive carrier as happened here.

EXAMPLE 3

Belts (75×1850 mm) were made by bonding abrasive mesh to a backing as in Example 1. One belt was a 3M 6400J standard N125 micron pattern 18 using BK18 abrasive mesh. A second belt was made using grit blasted BK18 as in Example 1. A third belt was prepared by bonding BK18 abrasive mesh to the backing using 3M Epoxy Tape 9245. The tape was rolled onto the back of the abrasive mesh using a hand held roller. The release paper was then removed from the tape and the material was again rolled onto the backing material. This sandwich was then cured between two press plates at a laminating temperature of 140° C. The belts were then tested on a revolving belt machine which was driven by an electric motor via a 200 mm diameter drive roller at a machine speed of 40 m/s with a contact wheel of 200 mm diameter using a 20 m diameter glass rod as test piece.

Each belt was subjected to a series of sequential tests as reported in the following Table. In each test, the glass rod was held in contact with the belt under the specified pressure until a 20, 30 or 40 mm increment of glass had been cut. The cycle was repeated for further increments until the total cut reported in the Table was reached. The time to achieve the specified cut was measured, and the cut rate calculated. The tests increased in severity until failure of the belts occurred. The following Table reports the conditions for each test, the total cut, the cut rate for each test and the overall cut rate.

| Test | Condition | Cut Rate mm/s standard | Cut Rate mm/s Example 1 | Cut Rate mm/s Epoxy | Total Cut mm |
|---|---|---|---|---|---|
| 1 | 1a | 5.11 | 4.70 | 6.00 | 220 |
| 2 | 2a | 2.73 | 2.90 | 4.80 | 940 |
| 3 | 2a | 1.76 | 2.28 | 2.20 | 1660 |
| 4 | 3a | 2.00 | 2.31 | 2.30 | 2380 |
| 5 | 3a | 1.65 | 2.02 | 1.85 | 3100 |
| 6 | 3b | 1.30 | 1.59 | 1.48 | 4180 |
| 7 | 3b | 0.91 | 1.13 | 1.33 | 5260 |
| 8 | 4a | 1.11 | 1.35 | 2.60 | 5620 |
| 9 | 4a | | 1.17 | 1.22 | 6340 |
| 10 | 4b | | 1.04 | | 7420 |
| 11 | 4c | | 0.72 | | 8860 |

condition 1a 6.2 Bar, 20 mm increments
condition 2a 8.2 Bar, 20 mm increments
condition 2a 8.2 Bar, 20 mm increments
condition 3a 10.C Bar, 20 mm increments
condition 3a 10.0 Bar, 20 mm increments
condition 3b 10.0 Bar, 30 mm increments
condition 3b 10.0 Bar, 30 mm increments
condition 4a 12.0 Bar, 30 mm increments
condition 4a 12.0 Bar, 30 mm increments
condition 4b 12.0 Bar, 30 mm increments
condition 4c 12.0 Bar, 40 mm increments

| | Standard | Grit blasted | Epoxy |
|---|---|---|---|
| Total Cut | 5620 mm | 8860 mm | 6250 mm |
| Total Time | 3838 secs. | 7769 secs. | 3391 secs. |
| Overall Cut Rate | 1.45 mm/s | 1.14 mm/s | 1.84 mm/s |
| End Point | Delamination | Delamination | Delamination |

The observations from this test are as follows:

3M grit blasted belt had the best total cut and the longest life indicating superior lamination strength. It was a significant improvement on the "standard" belt in both life and total cut.

The Epoxy belt gave the best cut rates particularly at the pressure changes, and whilst it was clearly better than the "standard" belt in terms of total cut, it was not better than the grit blasted construction.

What is claimed is:

1. An abrasive article comprising:

an abrasive fabric comprising a fabric having discrete areas of electro-deposited metal extending on or there-through and having abrasive material embedded in the metal, a layer of adhesive, and a backing substrate, the abrasive fabric being bonded to the backing substrate by the layer of adhesive, wherein the surface of at least the electro-deposited metal areas bonded to the backing is roughened and said metal surface has an increased Ra of at least 0.7 micrometers.

2. An abrasive article as claimed in claim 1 in which the metal is nickel.

3. An abrasive article as claimed in claim 1 in which the abrasive material is diamond or cubic boron mitride.

4. An abrasive article as claimed in claim 1 in which the layer of adhesive comprises a polyurethane adhesive.

5. An abrasive article as claimed in claim 1 in which the layer of adhesive is a hot-melt adhesive.

6. An abrasive article as claimed in claim 5 in which the layer of adhesive is a polyester.

7. An abrasive article as claimed in claim 1 in which the layer of adhesive comprises a pressure-sensitive thermosetting adhesive which is the photopolymerization reaction product of a blend consisting essentially of:

(a) from about 30% to about 80% by weight of a photopolymerisable monomeric or prepolymeric syrup containing an acrylic acid ester of a nontertiary alcohol, and a moderately polar copolymerisable monomer;

(b) from about 20% to about 60% by weight of an epoxy resin or a mixture of epoxy resins containing no photopolymerisable groups;

(c) from about 0.50% to about 10% by weight of a heat-activatable hardener for the epoxy resin;

(d) from about 0.01% to about 5% of a photoinitiator; and (e) from 0% to about 5% of a photocrosslinking agent.

8. An abrasive article as claimed in claim 1 in which the surface roughening is obtained by abrading.

9. An abrasive article as claimed in claim 1 in which the surface roughening is obtained by grit blasting.

10. An abrasive article as claimed in claim 1 in the form of a belt.

11. An abrasive article as claimed in claim 1 in the form of a pad, disc, block, strip or roll.

12. A method of making an abrasive article comprising the steps of:

providing an abrasive fabric comprising a fabric having discrete areas of electro-deposited metal extending on or therethrough and having abrasive material embedded in the metal, and bonding the abrasive fabric to a backing substrate with a layer of adhesive wherein the surface of at least the electro-deposited metal areas bonded to the backing is roughened and said metal surface has an increased Ra of at least 0.7 micrometers.

13. A method as claimed in claim 12 in which the surface is roughened by abrading.

14. A method as claimed in claim 13 in which the surface is abraded by grit blasting.

15. A method as claimed in claim 14 in which the grit blasting is conducted using 36 to 80 grit size.

16. A method as claimed in claim 14 in which the grit is selected from aluminum oxide and chilled iron grit.

17. A method as claimed in claim 12 in which the adhesive layer comprises a polyurethane adhesive.

18. A method as claimed in claim 12 in which the layer of adhesive is a hot-melt adhesive.

19. A method as claimed in claim 18 in which the layer of adhesive is a polyester.

20. A method as claimed in claim 12 in which the layer of adhesive comprises a pressure-sensitive thermosetting adhesive, which is the photopolymerization reaction product of a blend consisting essentially of:

(a) from about 30% to about 80% by weight of a photopolymerisable monomeric or prepolymeric syrup containing an acrylic acid ester of a nontertiary alcohol, and a moderately polar copolymerisable monomer;

(b) from about 20% to about 60% by weight of an epoxy resin or a mixture of epoxy resins containing no photopolymerisable groups;

(c) from about 0.5% to about 10% by weight of a heat-activatable hardener for the epoxy resin;

(d) from about 0.01% to about 5% of a photoinitiator; and (e) from 0% to about 5% of a photocrosslinking agent.

21. The abrasive article of claim 1 wherein the layer of adhesive comprises an epoxy-acrylate thermosetting adhesive.

* * * * *

UNITED STATES PATENT AND TRADEMARK OFFICE

CERTIFICATE OF CORRECTION

PATENT NO. : 6,372,001 B1
DATED : April 16, 2002
INVENTOR(S) : Omar, Mohamed

It is certified that error appears in the above-identified patent and that said Letters Patent is hereby corrected as shown below:

Column 6,
Line 24, delete “BK1 8” and insert in place thereof -- BK18 --.

Column 8,
Line 65, delete “mitride” and insert in place thereof -- nitride --.

Signed and Sealed this

Fifteenth Day of February, 2005

JON W. DUDAS
*Director of the United States Patent and Trademark Office*